US010968542B2

(12) United States Patent
Krejci

(10) Patent No.: US 10,968,542 B2
(45) Date of Patent: Apr. 6, 2021

(54) RING SPINNING MACHINE WITH DISPLACEABLY SUPPORTED SPINDLE RAIL

(71) Applicant: Maschinenfabrik Rieter AG, Winterthur (CH)

(72) Inventor: Emil Krejci, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 92 days.

(21) Appl. No.: 16/183,936

(22) Filed: Nov. 8, 2018

(65) Prior Publication Data

US 2019/0145024 A1 May 16, 2019

(30) Foreign Application Priority Data

Nov. 10, 2017 (CH) ..... 01357/17

(51) Int. Cl.

| | |
|---|---|
| ***D01H 1/22*** | (2006.01) |
| ***D01H 1/02*** | (2006.01) |
| ***D01H 1/244*** | (2006.01) |
| ***D01H 1/16*** | (2006.01) |
| ***D01H 7/10*** | (2006.01) |

(52) U.S. Cl.

CPC ..... *D01H 1/22* (2013.01); *D01H 1/02* (2013.01); *D01H 1/162* (2013.01); *D01H 1/244* (2013.01); *D01H 7/10* (2013.01); *D01H 2700/205* (2013.01)

(58) Field of Classification Search

CPC ..... D01H 1/22; D01H 1/02; D01H 1/162
USPC ..... 57/136, 137; 19/258
See application file for complete search history.

(56) References Cited

U.S. PATENT DOCUMENTS

| | | | | |
|---|---|---|---|---|
| 366,238 A * | 7/1887 | Newell | ..... | D01H 1/02 57/75 |
| 624,148 A * | 5/1899 | Allgood | ..... | D01H 1/02 57/359 |
| 739,840 A * | 9/1903 | Daudelin | ..... | D01H 1/02 57/359 |

(Continued)

FOREIGN PATENT DOCUMENTS

| | | |
|---|---|---|
| CH | 130 387 | 2/1929 |
| CH | 711 696 A2 | 4/2017 |

(Continued)

OTHER PUBLICATIONS

CH Search Report, dated Feb. 6, 2018.

*Primary Examiner* — Shaun R Hurley
*Assistant Examiner* — Bao-Thieu L Nguyen
(74) *Attorney, Agent, or Firm* — Dority & Manning, P.A.

(57) ABSTRACT

A ring spinning machine includes a reciprocating, displaceably supported spindle rail that is driven by a motor via a shaft that passes through the ring spinning machine. The spindle rail is arranged along opposite sides of the ring spinning machine in a longitudinal orientation of the ring spinning machine and is subdivided into sections along each of the opposite sides. Cross braces extend between the opposite sides of the ring spinning machine and connect opposite sections of the spindle rail. The shaft is supported between the sections of the spindle rail. The spindle rail is suspended from at least one cam disc that is seated on the shaft. A circumferentially biased spring is configured with the shaft or the cam disc to provide torsional compensation on the shaft.

15 Claims, 2 Drawing Sheets

(56) References Cited

U.S. PATENT DOCUMENTS

| | | | | | |
|---|---|---|---|---|---|
| 1,978,001 | A * | 10/1934 | Seaman | D01H 1/02 | 57/75 |
| 2,295,935 | A * | 9/1942 | Cotchett | D01H 1/162 | 57/1 R |
| 2,658,327 | A * | 11/1953 | Keyser | D01H 1/36 | 57/92 |
| 2,690,641 | A * | 10/1954 | Keyser | D01H 1/162 | 57/1 R |
| 2,820,336 | A * | 1/1958 | Sagehomme | D01H 1/02 | 57/94 |
| 2,912,815 | A * | 11/1959 | Feather | D01H 1/02 | 57/66 |
| 2,923,119 | A * | 2/1960 | Nifenecker | D01H 1/162 | 57/1 R |
| 2,993,331 | A * | 7/1961 | Birkigt | D01H 1/162 | 57/1 R |
| 3,196,600 | A * | 7/1965 | McDuffy, Jr. | D01H 1/02 | 57/277 |
| 3,246,855 | A * | 4/1966 | Preston | D01H 1/02 | 242/164 |
| 3,325,985 | A * | 6/1967 | Bucher | D01H 1/305 | 57/93 |
| 3,339,361 | A * | 9/1967 | Bryan, Jr. | D01H 5/82 | 57/92 |
| 3,358,432 | A * | 12/1967 | Croxton | D01H 1/02 | 57/327 |
| 3,521,441 | A * | 7/1970 | Lamparter | D01H 1/32 | 57/90 |
| 3,868,814 | A * | 3/1975 | Chiari | D01H 11/006 | 57/305 |
| 4,255,925 | A * | 3/1981 | Marzoli | D01H 1/16 | 57/1 R |
| 4,330,987 | A * | 5/1982 | Schippers | D01H 13/04 | 57/1 R |
| 5,016,434 | A * | 5/1991 | Kamp | B65H 54/72 | 242/473.5 |
| 5,343,685 | A * | 9/1994 | Burgermeister | D01H 1/162 | 57/1 R |
| 2007/0044277 | A1* | 3/2007 | Feuerlohn | D01H 1/22 | 19/236 |
| 2011/0078992 | A1 | 4/2011 | Abbasi | | |

FOREIGN PATENT DOCUMENTS

| | | | |
|---|---|---|---|
| CN | 201003088 | Y | 1/2008 |
| DE | 688 079 | | 1/1940 |
| DE | 2099 | A | 10/1952 |
| DE | 878 013 | C | 5/1953 |
| DE | 41 02 549 | A1 | 7/1992 |
| DE | 196 18 260 | A1 | 11/1997 |
| DE | 10 2004 047 230 | A1 | 3/2006 |
| DE | 10 2004 055 519 | B3 | 7/2006 |
| DE | 10 2007 000 425 | A1 | 2/2009 |
| FR | 351 420 | A | 7/1905 |
| GB | 674466 | | 6/1952 |

* cited by examiner

RING SPINNING MACHINE WITH DISPLACEABLY SUPPORTED SPINDLE RAIL

TECHNICAL FIELD

The invention relates to a ring spinning machine with a displaceably supported spindle rail.

BACKGROUND

Spindle rails of a ring spinning machine have a certain length, and a plurality of spindles are arranged next to one another thereon. Multiple spindle rails are joined together when assembling a spinning or twisting machine in the longitudinal direction and thus constitute a supporting element of the machine frame of the spinning or twisting machine. Spindle rails can be can be supported in a stationary or displaceable manner.

In ring spinning or ring twisting machines with upwardly and downwardly displaceable spindle rails, the yarn balloon always remains constant, so that—unlike with an upwardly and downwardly displaceable ring rail—there are no extreme positions in which the stress on the yarn increases when running onto the package. This results in a lower number of yarn breaks compared to ring spinning or ring twisting machines with upwardly and downwardly displaceable ring rails. In the latter-mentioned machines, the yarn tension is reduced due to the fact that the spindle speed is reduced momentarily in the extreme positions of the ring rail. However, this results in reduced production capacity. In the case of ring spinning or ring twisting machines with an upwardly and downwardly displaceable spindle rail, on the other hand, the spinning speed can be increased, and the time period of reduced speed is shortened to the minimum amount required while spinning on or off. This results in fewer variations in yarn elasticity overall, which leads to improved conditions for subsequent rewinding. Moreover, the equipment for different strokes in yarns guides, balloon control rings, and spinning rings is dispensed with.

In a ring spinning or ring twisting machine of this type (DE 688079), the opposing spindle rail sections of two machine longitudinal sides are interconnected by transverse webs. Preferably, a four-spindle belt drive is provided with which two spindles are associated on one machine longitudinal side and two spindles are associated on the other machine longitudinal side. Alternatively, a separate drive can be provided for each of the two machine longitudinal sides, for which purpose two rows of drive wheels are arranged in the machine longitudinal direction. Because of the stationarily arranged drive motor, length equalization is provided for the drive belts.

DE 19618260 relates to a ring spinning or ring twisting machine having, on each machine longitudinal side, a plurality of spindle rail sections that can be displaced upward and downward at the same time but are otherwise independent from one another, as well as drive belt-containing drive means for the spindles, each of which is associated with only one machine longitudinal side.

It is already known from DE 4102549 A1 to associate with each spindle its own jointly movable drive motor in machines in which both the spindle rail and the ring rail respectively perform raising and lowering movements.

CH 130387 discloses a spinning and twisting machine with a fixed ring rail and a moving spindle rail. It is characterized in that an intermediate gear is arranged between the fixedly supported main drive wheel and the drive wheel of the spindle drive shaft that is sitting on the spindle rail, which enables the displacement of the spindle rail.

US 20110078992 discloses a ring spinning machine with a displaceable spindle rail. The spindles are respectively driven in pairs by belts.

DE 102007000425 A1 relates to a spinning station of a spinning machine with a spindle rail that extends over the length of the machine and carries a plurality of such spinning stations, each with a spindle-bearing spindle rail, with each of the spindles being driven by an associated electric motor.

CH 711696 A2 discloses a spinning and twisting machine with a holding fixture and at least one spindle rail that is held by the holding fixture so as to be displaceable in a lifting motion along a guide. It is characterized in that the holding fixture holds a pulley device with a drawstring that is guided alternately over at least one loose and fixed roll.

One drawback of these designs is that, with very long machines, torsion can occur in the central shaft that holds the moving spindle rail, which can result in substantial deviations in the reciprocating movement of the spindle rail, depending on the machine length.

SUMMARY

It is an object of the invention to provide a ring spinning machine with a moving spindle rail that avoids the drawbacks of the prior art.

In particular, it is an object of the invention to provide a ring spinning machine with a moving spindle rail that provides torsional compensation in the shaft on which the spindle rail is suspended.

It is another object of the invention to provide a ring spinning machine with a moving spindle rail that enables uniform lifting of the spindle rail even in long machines.

It is another object of the invention to provide a ring spinning machine with a moving spindle rail that has a simplified reciprocating mechanism for moving the spindle rail.

It is another object of the invention to provide a ring spinning machine with a moving spindle rail that is subdivided into sections and provides section-wise compensation for thermal fluctuations in the longitudinal direction.

Additional objects and advantages of the invention will be set forth in part in the following description, or may be obvious from the description, or may be learned through practice of the invention.

These objects are achieved in a ring spinning machine, which is characterized in that the spindle rail is suspended on at least one cam disc that is seated on the shaft, and that torsional compensation is provided on the shaft by means of at least one circumferentially biased spring.

Advantageously, the cam discs are designed such that the torque generated by the springs in the stroke path of the spindle rail is substantially (completely or almost completely) compensated for.

Two oppositely biased springs can be present for each section of the spindle rail, one at each end or in the center of the section. The spring(s) can be securely attached to a frame of the spindle rail at one end and connected to the shaft or a cam disc at another end. The spindle rails can be suspended symmetrically on two cam discs on one respective belt in sections, with the bias of the springs acting counter to the direction of rotation that the belt acts on the shaft via the cam disc.

This embodiment of the invention advantageously results in good torsional compensation in long machines and leads to uniform raising and lowering of the spindle rail.

The motor for driving the continuous shaft is arranged in a head or foot of the ring spinning machine, or one or two motors can be centrally located between two machine parts, with the two machine parts, independently of one another, having a continuous shaft for driving the spindle rail that is driven by the motor or motors.

The spindle rail can be advantageously suspended in sections on the cross braces that connect the longitudinal sides of the spindle rail. This also ensures a stable design.

The ends of two adjacent sections of the spindle rail can be connected together at a cross brace of the ring spinning machine, in which case one end is securely connected to the cross brace and the other end is connected to the cross brace so as to enable longitudinal thermal expansion to be compensated for; for example, one end can be securely screwed to the cross brace, and the other end can be connected to the cross bar by a spring connection or a sliding connection.

In another embodiment, the fixed ends of a section can be oppositely situated on opposite sides of the ring spinning machine or, alternatively, they can be arranged opposite a movable end of the section.

BRIEF DESCRIPTION OF THE FIGURES

Additional advantages of the invention are described in the following exemplary embodiments. In the drawing.

Only the features that are important to the invention are illustrated. Identical features have the same reference symbols in different figures.

DETAILED DESCRIPTION

Figure 1:
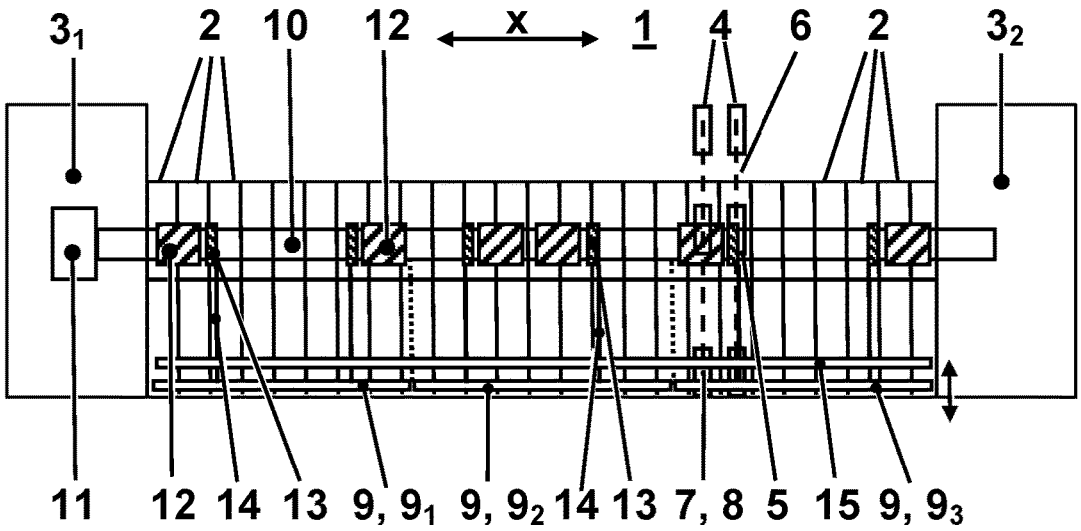
FIG. 1 shows a schematic view of a ring spinning machine with a moving spindle rail.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a ring spinning machine 1 according to the invention having a plurality of adjacently arranged spinning stations 2. The spinning stations 2 are arranged in a longitudinal direction x of the ring spinning machine 1 between a head $\mathbf{3}_1$ and a foot $\mathbf{3}_2$. Head $\mathbf{3}_1$ and foot $\mathbf{3}_2$ of the ring spinning machine 1 may include bearings, drives, control means, etc., that are necessary for the operation of the machine. As can also be seen at two spinning stations 2 that are shown schematically in FIG. 1, for example, each spinning station 2 consists of a roving package 4 that is arranged above a drawing frame 5 and on which a roving 6 is wound. The roving 6 runs from the roving package 4 via the drawing frame 5, where it is stretched and then guided to a yarn-forming element. A circulating traveler or ring traveler guides the finished yarn onto a cop 7 placed on a driven spindle 8. The ring rail 15 is shown schematically in FIG. 1. The ring spinning machine 1 can have a symmetrical construction, with corresponding spinning stations being located on the opposite side.

The spindles 8 are arranged on a reciprocating, displaceably supported spindle rail 9 (direction of movement indicated by the arrow), which is shown schematically in FIG. 1. The spindle rail 9 is subdivided along the length of the machine into different sections $\mathbf{9}_1$, $\mathbf{9}_2$, $\mathbf{9}_3$, with the number and length of the sections $\mathbf{9}_1$, $\mathbf{9}_2$, $\mathbf{9}_3$ of the spindle 9 depending on the specific design of the machine. A spindle rail 9 is located on either side of the ring spinning machine 1; these spindle rails 9 are interconnected by cross braces 17, 17.1 (see FIG. 2). The spindle rail 9 is driven by means of a continuous shaft 10 that runs centrally through the machine 1 and is driven by a motor 11. The continuous shaft 10 is supported in the head $\mathbf{3}_1$ and foot $\mathbf{3}_2$ of the ring spinning machine 1 and on intermediate frames 16 (see FIG. 2). In another embodiment (not shown), the motor 11 is arranged so as to drive the shaft 10 centrally in the center of the ring spinning machine 1, and a respective shaft 10 extends from the center along the longitudinal direction x to the head $\mathbf{3}_1$ and foot $\mathbf{3}_2$ of the ring spinning machine 1. In another embodiment, two motors 11 are arranged centrally, and each shaft 10 extends in a respective direction to the head $\mathbf{3}_1$ and foot $\mathbf{3}_2$ of the ring spinning machine 1.

Figure 2:
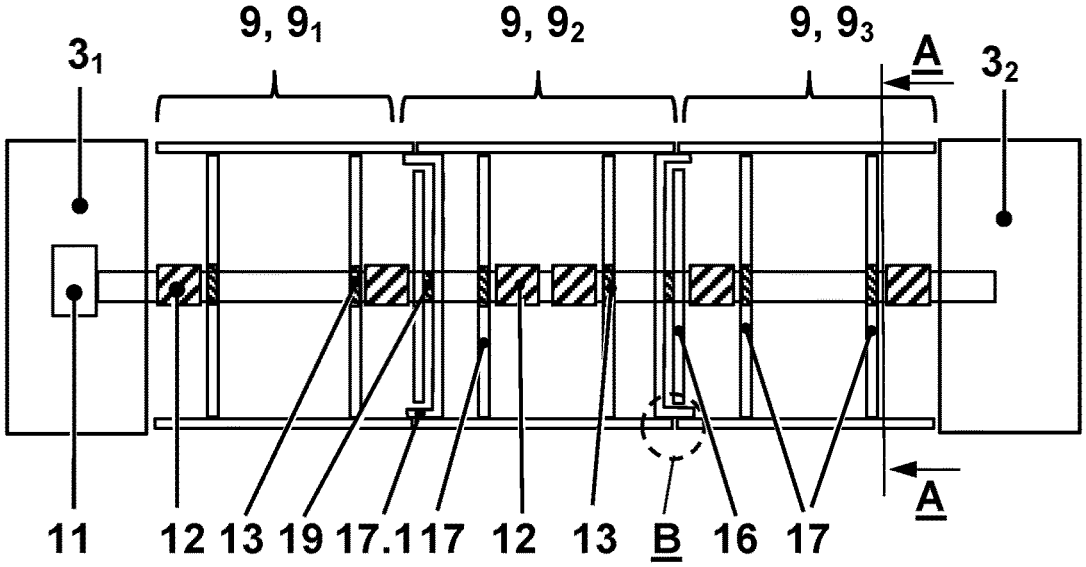
FIG. 2 shows a schematic plan view of a ring spinning machine according to FIG. 1.

FIG. 2 shows a schematic plan view of a ring spinning machine according to FIG. 1. The intermediate frames 16 divide the ring spinning machine 1 into the designated sections $\mathbf{9}_1$, $\mathbf{9}_2$, $\mathbf{9}_3$. Moreover, cross braces 17, 17.1 are located between the longitudinal sides of the spindle rail 9. For example, as is shown, there are two cross connections 17 without a guide for each section $\mathbf{9}_1$, $\mathbf{9}_2$, $\mathbf{9}_3$, and in section $\mathbf{9}_2$, there are two cross braces 17.1 with a guide 19 to the respective intermediate frame 16.

Two circumferentially biased springs 12 are located on the shaft 10 in each section and, for each spring 12, there is a cam disc 13 on which the frame of the spindle rail 9 is suspended by means of a belt 14. As a result of the rotation of the shaft 10 by means of the motor 11, the spindle rail 9 is moved up and down by means of the cam disc 13 and the belt 14. The biased springs 12 are securely attached to the frame at one end, and they can be attached either to the shaft 10 or to the cam disc 13 on the other side. The bias of the springs 12 changes as a result of the rotation of the shaft 10 when the spindle rail 9 is raised and lowered. The cam discs are designed such that the torque generated by the springs in the stroke path of the spindle rail is substantially (completely or almost completely) compensated for. The springs 12 can be mounted at the beginning and end of a section (section $\mathbf{9}_1$, $\mathbf{9}_3$), or they can extend centrally in a section, each in one direction (middle section $\mathbf{9}_2$). Although not shown, it is alternatively conceivable for no spring 12 to be provided in certain sections (in every other section, for example).

Figure 3:
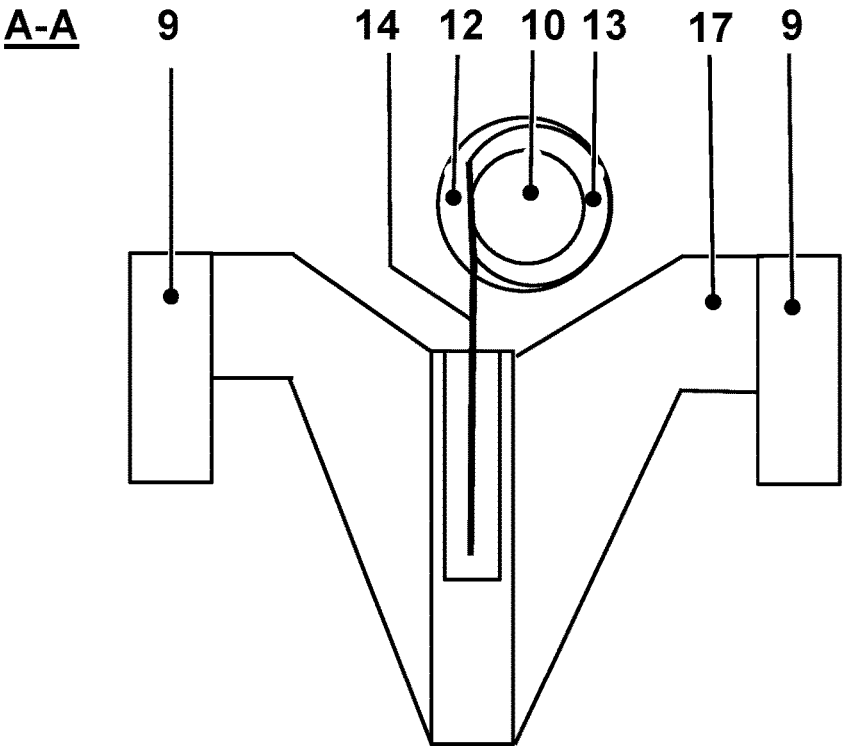
FIG. 3 shows a schematic section along A-A of FIG. 2.

FIG. 3 shows a schematic section along A-A of FIG. 2. The shaft 10, the cam disc 13 located on the shaft 10, and the biased spring 12 are visible. The cross braces 17 are securely connected to the spindle rail 9. The cross braces 17 are suspended over the belt 14 on the cam discs 13. As a result of the rotation of the shaft 10, the belt 14 is unwound from the cam disc 13 when the spindle rail 9 is lowered or wound thereon when raised. The spindle rail 9 moves up or down, accordingly. The belt 14 is attached to the cross braces 17 by means of a secure screw, clamp, or other connection. It is also conceivable for the belt 14 to be attached to the respective cross brace 17.1.

The embodiment of the invention advantageously results in good torsional compensation in long machines and leads to uniform raising and lowering of the spindle rail.

Figure 4:
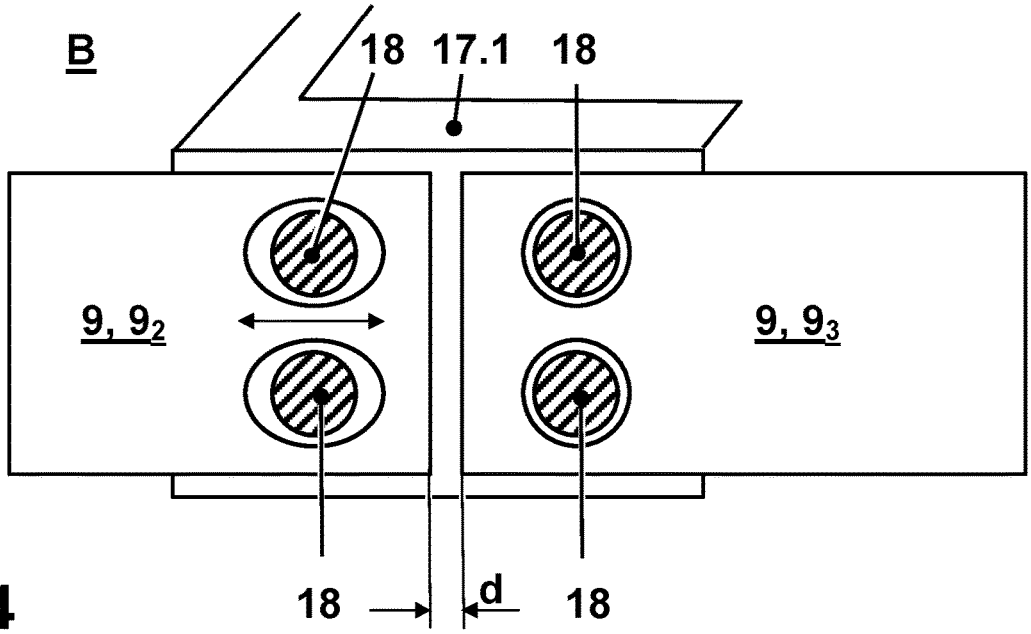
FIG. 4 shows schematic detail B of FIG. 2.

With the detail B of FIG. 2, FIG. 4 shows a schematic view of the connection of the sections $9_1$, $9_2$, $9_3$ of the spindle rail 9 to the cross braces 17.1 with guide 19. The ends of the sections $9_1$, $9_2$, $9_3$ of the spindle rail 9 at the cross braces 17.1 are connected to each other so as to provide compensation for thermal longitudinal expansion of the longitudinal sides within a section $9_1$, $9_2$, $9_3$. This occurs due to the fact that one end of a section $9_1$, $9_2$, $9_3$ is securely connected to the cross braces 17.1 by means of screws, for example. The other end of a section $9_1$, $9_2$, $9_3$ is connected to the next cross braces 17.1 such that an allowance is provided here in order to compensate for thermal expansion (see arrow). In FIG. 4, one end of the section $9_3$ is fixed with screws to the cross brace 17.1, and the end of the section $9_2$ is fixed with screws 18 to the cross brace 17.1, but in such a way that the end is able to move and/or expand within certain limits. Thermal fluctuations can thus be compensated for. In another embodiment, the fixed ends of a section $9_1$, $9_2$, $9_3$ can be oppositely situated on opposite sides of the ring spinning machine 1 or, alternatively, they can be arranged opposite a movable end of the section $9_1$, $9_2$, $9_3$.

Modifications and variations can be made to the embodiments illustrated or described herein without departing from the scope and spirit of the invention as set forth in the appended claims.

LIST OF REFERENCE SYMBOLS

1 ring spinning machine
2 spinning stations
$3_1$ head of the ring spinning machine 1
$3_2$ foot of the ring spinning machine 1
4 roving package
5 drawing frame
6 roving
7 cop
8 spindle
9 spindle rail
$9_1$, $9_2$, $9_3$ sections of the spindle rail 9
10 shaft
11 motor
12 spring
13 cam disc
14 belt
15 ring rail
16 intermediate frame
17 cross brace without guide
17.1 cross brace with guide 19
18 screws
19 guide
d distance
x longitudinal direction of the ring spinning machine 1

The invention claimed is:

1. A ring spinning machine, comprising:
a reciprocating, displaceably supported spindle rail with a plurality of spindles configured thereon;
the spindle rail driven by a motor via a shaft that passes through the ring spinning machine;
the spindle rail arranged along opposite sides of the ring spinning machine in a longitudinal orientation of the ring spinning machine;
the spindle rail subdivided into sections along each of the opposite sides;
cross braces extending between the opposite sides of the ring spinning machine and connecting opposite sections of the spindle rail;
the shaft supported between the sections of the spindle rail,
the spindle rail suspended from at least one cam disc that is seated on the shaft;
a circumferentially biased spring configured with the shaft or the cam disc to provide torsional compensation on the shaft; and
the spindle rail driven in a reciprocating vertical path by rotation of the cam disc and shaft during spinning operations of the ring spinning machine.

2. The ring spinning machine as set forth in claim 1, wherein the cam disc comprises a design such that torque generated by the spring on a stroke path of the spindle rail is substantially compensated for.

3. The ring spinning machine as set forth in claim 1, comprising two of the biased springs for each section of the spindle rail biased in opposite directions, each of the springs having one of the cam discs associated therewith.

4. The ring spinning machine as set forth in claim 3, wherein two oppositely-biased springs are located at each end or in the center of each section of the spindle rail.

5. The ring spinning machine as set forth in claim 1, wherein the spring is connected at one end to a frame or an intermediate frame, and to the shaft or the cam disc at another end.

6. The ring spinning machine as set forth in claim 1, the spindle rail is suspended on the cam disc with a belt.

7. The ring spinning machine as set forth in claim 6, comprising two of the biased springs for each section of the spindle rail biased in opposite directions, each of the springs having one of the cam discs associated therewith, wherein each section of the spindle rail is suspended symmetrically with the belts on two cam discs.

8. The ring spinning machine as set forth in claim 7, wherein bias of the springs acts counter to a direction of rotation that the associated belt acts on the shaft via the cam disc.

9. The ring spinning machine as set forth in claim 1, wherein the motor is arranged in a head or a foot section of the ring spinning machine.

10. The ring spinning machine as set forth in claim 1, wherein the ring spinning machine is separated into two machine parts, with each of the machine parts comprising the spindle rail and independently driven shaft, wherein at least one motor is arranged centrally between two machine parts for driving the shafts.

11. The ring spinning machine as set forth in claim 1, wherein the spindle rail is suspended on the cross braces in the sections.

12. The ring spinning machine as set forth in claim 1, wherein ends of two adjacent sections of the spindle rail are connected to one another with one of the cross braces so as to compensate for longitudinal thermal expansion between the sections.

13. The ring spinning machine as set forth in claim 12, wherein the end of one of the adjacent sections is securely fixed to the cross brace and the end of the other adjacent section is movably connected by a spring connection or a sliding connection to the cross brace so as to compensate for the longitudinal thermal expansion between the sections.

14. The ring spinning machine as set forth in claim 13, wherein the fixed ends of the adjacent sections are oppositely situated on the cross brace at opposite sides of the machine frame.

15. The ring spinning machine as set forth in claim 13, wherein the fixed end of the adjacent section is opposite to the movably connected end of the adjacent section on the cross brace at the opposite machine side of the machine frame.

* * * * *